US008635976B2

(12) United States Patent
Gayheart et al.

(10) Patent No.: US 8,635,976 B2
(45) Date of Patent: Jan. 28, 2014

(54) ECONOMIZER ARRANGEMENT FOR STEAM GENERATOR

(75) Inventors: Jeb W. Gayheart, Akron, OH (US); Donald E. Ryan, Diamond, OH (US); Robert M. McNertney, Canal Fulton, OH (US); Peter W. Waanders, Wadsworth, OH (US); Geza G. Csatlos, Wadsworth, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 372 days.

(21) Appl. No.: 11/750,271

(22) Filed: May 17, 2007

(65) Prior Publication Data

US 2008/0282997 A1 Nov. 20, 2008

(51) Int. Cl.
*F22B 37/24* (2006.01)

(52) U.S. Cl.
USPC ..... 122/510; 122/441

(58) Field of Classification Search
USPC ..... 122/441, 510, 511; 376/462
See application file for complete search history.

(56) References Cited

U.S. PATENT DOCUMENTS

| | | | | | |
|---|---|---|---|---|---|
| 4,307,777 | A * | 12/1981 | Chwyla | ..... | 165/76 |
| 4,346,316 | A * | 8/1982 | Wysk et al. | ..... | 310/11 |
| 4,421,070 | A * | 12/1983 | Sullivan | ..... | 122/510 |
| 5,361,827 | A * | 11/1994 | Brown et al. | ..... | 165/103 |
| 5,791,300 | A * | 8/1998 | Phelps, Sr. | ..... | 122/459 |
| 7,021,248 | B2 * | 4/2006 | McNertney et al. | ..... | 122/7 R |

* cited by examiner

*Primary Examiner* — Gregory A Wilson
(74) *Attorney, Agent, or Firm* — Eric Marich

(57) ABSTRACT

An economizer arrangement particularly suitable for new or retrofit application to existing steam generators provides a water cooled stringer support tube system which can accommodate firing a wide range of fuels with varying characteristics in the steam generator. The economizer arrangement according to the present invention is particularly suited for retrofit applications to large supercritical steam generators. The use of water cooled stringer tube supports allows for higher flue gas temperatures in comparison to conventional non-cooled mechanical economizer supports. These features are provided in a design which fits within the existing economizer envelope of the steam generator.

14 Claims, 8 Drawing Sheets

SECTION 7-7

ECONOMIZER ARRANGEMENT FOR STEAM GENERATOR

FIELD AND BACKGROUND OF THE INVENTION

The present invention relates generally to steam generators used in the production of steam for electric power generation and, more particularly, to method and apparatus for modifying an existing steam generator to accommodate the firing of different coals which have markedly different combustion characteristics, such as the resulting flue gas temperature when the coal is burned.

For a general description of boilers or steam generators used in the production of steam for industrial or utility applications, the reader is referred to *Steam/its generation and use*, 41$^{st}$ Edition, Kitto and Stultz, Eds., Copyright© 2005, The Babcock & Wilcox Company, the text of which is hereby incorporated by reference as though fully set forth herein.

FIG. 1 illustrates a 1300MW supercritical pressure, UP® steam generator designed and manufactured by The Babcock & Wilcox Company. Briefly, coal is ground to a desired fineness and conveyed to the furnace via burners which mix the pulverized coal with air in a combustion process. Hot flue gases created during combustion flow upwardly through the furnace. The furnace walls are of welded, membrane tube wall construction. The tubes forming the walls convey a working fluid therethrough which absorbs heat from the combustion process in order to produce steam. The flue gases flow from the furnace and across various banks of heating surface comprised of tubes. Secondary superheater and reheat superheater (pendant) are located at the upper portion of the steam generator. These banks of heating surface extract heat from the flue gases flowing there across, increasing the temperature of the working fluid conveyed within these tubes, while the temperature of the flue gases gradually decreases. The flue gases then travel into the convection pass, and thence downwardly across additional banks of heating surface which are also comprised of tubes which convey a working fluid; i.e., primary superheater, reheat superheater (horizontal) and economizer. The flue gases then exit from the steam generator and are conveyed to air heaters which extract additional heat from the flue gases which is used to preheat the incoming air which is used for combustion. Some of the air for combustion is used to dry and transport the pulverized coal from the pulverizers to the burners, and is referred to as primary air; the balance of the combustion air is generally referred to as secondary air and is conveyed to the burners via the forced draft fan(s). In the steam generator shown, an older version of steam temperature control is illustrated which utilized a combination of gas tempering ports and gas recirculating fans to distributed combustion flue gases at appropriate locations. As is known to those skilled in the art, other steam temperature control methods are known which do not utilize gas tempering and gas recirculation but otherwise the basic operational principles of such steam generators remains the same.

It will thus be appreciated that, in the production of electricity, various pieces of equipment are necessary. The boiler or steam generator is a combination of many pieces of equipment, which when combined use the heat released by the combustion of fossil fuels to heat the working fluid, typically water, and produce superheated steam. The steam has a large amount of energy, which is used to spin the blades of a turbine. The boiler fires a fossil fuel, such as coal, which produces the high temperature flue gas that passes across the several different types of heat exchangers which transfer heat from the flue gas into the water and steam system. The first heat exchanger where the water absorbs heat from the flue gas is the economizer.

FIG. 2 is a perspective illustration of a known economizer, generally designated 10, comprised of an inlet bank 12 and an outlet bank 14, and which would be typically located in the lower portion of a steam generator convection pass. Additional banks of economizer may also be provided, intermediate to the inlet and outlet banks, depending upon the requirements of a particular steam generator. The economizer 10 is comprised of hundreds of tubes 16 arranged in a serpentine pattern. An economizer inlet header receives water and distributes the water among the various tubes 16. The tubes 16 convey the water upwardly, counterflow to the direction of combustion flue gas flow, as shown, absorbing heat from the flue gases. At the water outlet (flue gas inlet) of the economizer outlet bank 14, intermediate headers 20 collect the heated water from the individual tubes 16, mixing out any imbalances in heat absorption. The intermediate headers 20, in turn, are connected to economizer stringer tubes 22 which convey the heated water upwardly through (inbetween) the tubes which comprise banks of other types of heating surface. As shown in FIG. 2, a horizontal primary superheater inlet bank 30 is located immediately above the economizer 10. The intermediate headers 20 serve several purposes. First, they serve as a mix point to eliminate imbalances in the temperature of the water which has been heated during its passage through the economizer 10. Second, the side to side spacing of the stringer tubes 22 can be selected to exactly accommodate the side to side spacing of the above located heating surfaces through which they pass; in the case shown, the side to side spacing of the primary superheater 30. In addition, the intermediate headers 20 can be located as required so that the stringer tubes 22, and the attached mechanical supports 24 hung off of the stringer tubes 22, and the non-cooled mechanical ladder bar supports 26, can be positioned as desired.

As described in the aforementioned *Steam* 41$^{st}$ reference, economizers are located within tube wall enclosures or within casing walls, depending on gas temperature. In general, casing enclosures are used at or below 850 F (454 C) and inexpensive carbon steel can be used. If a casing enclosure is used, it must not support the economizer. However, tube wall enclosures may be used as supports.

The number of support points is determined by analyzing the allowable deflection in the tubes and tube assemblies. Deflection is important for tube drainability. FIGS. 2, 3, 4 and 5 illustrate other economizer support arrangements.

As shown in FIG. 3, wall or end supports are usually chosen for relatively short spans and require bridge castings 40 or individual lugs 42 welded or attached to the tube wall enclosures 44. Vibration dampers 46 may be provided on individual tube banks to reduce flue gas flow induced vibration. As illustrated in FIG. 4, another possibility exists if enclosure wall (usually primary superheater circuitry) headers, such as lower convection pass enclosure wall headers 50, are present above the economizer 10. In this case, the support mechanism is again via non cooled mechanical supports, this time in the form of end support bars 52 which engage the ends of the tubes 16 forming the banks 12, 14 of economizer 10.

Quarter point stringer supports are used for spans exceeding the limits for end supports; this situation is illustrated in FIG. 5. The stringers 22 are mechanically connected at 24 to the economizer sections 14, etc., which are held up by ladder type supports 26. The supports exposed to hot inlet gases may be made of stainless steel, while lower grade material is normally used to support the lower bank which is exposed to reduced gas temperatures. In the B&W designs, stringer tubes 22 also usually support other horizontal convection surfaces above the economizer 10. Bottom support is sometimes used if the gas temperature leaving the lowest economizer bank 12 is low enough.

Economizers are thus generally supported in one of two manners depending on the enclosure surrounding the economizers. If the enclosure is a tube wall enclosure and the span of the economizer is not too long then the economizer is supported from the tube walls by bridge castings and support lugs. If the enclosure is casing and a primary or reheat superheat header is located above the economizer, non-cooled mechanical support ladder bars may be used for support.

The Babcock & Wilcox Company (B&W) has used the term stringer supported economizer in the past. However, in those designs the stringer tubes have not been routed through the economizer. Instead, as illustrated in FIGS. 2 and 5 discussed above, the actual support of the banks 12, 14 of economizer 10 used non-cooled mechanical ladder bar supports 26 which were connected via mechanical supports 24 to the economizer intermediate headers 20. The economizer intermediate headers 20 were then supported by the stringer tubes 22 in the upper elevations of the convection pass area where the flue gas temperatures are higher.

For many electric utilities, economics and emissions regulations have caused plant owners to switch fuels from the original design fuels. Steam generators are generally designed to accommodate a particular type of coal, which sets the furnace sizing and heat input parameters, the slagging and fouling indices, the coal pulverizers and associated burners, air heaters, etc. For a given furnace size and firing condition, the choice of fuel also determines the furnace exit gas temperature of the flue gas leaving the furnace and that temperature, as well as the gas weights, gas properties, and other heat transfer parameters are used to design the particular arrangement of superheater, reheater and economizer surface which will be provided. Combustion of a different coal in a steam generator which was not originally designed for that coal will usually result in different performance. In many instances, such a fuel switch often results in higher flue gas temperatures exiting from the furnace and such increased temperature profiles persist throughout the radiant and convective gas path, including the gas temperature entering the economizer. These higher temperatures can cause the traditional non-cooled mechanical support systems to become bulky and cost prohibitive. Accordingly, a cost effective, fuel flexible steam generator arrangement and a method of retrofitting existing steam generators which would provide such flexibility would be welcomed by industry.

SUMMARY OF THE INVENTION

The economizer design according to the present invention has been enhanced from the existing economizer designs by the addition of features which permit a wide range of fuels to be fired in the steam generator.

Various fuels provide different issues in the design of boiler components—higher boiler exit flue gas temperatures, different tendencies to slag and foul components, which can exacerbate temperature concerns, and different erosion rates due to varying characteristics of the ash of the fuels.

The economizer arrangement according to the present invention is particularly suited for retrofit to the aforementioned 1300MW supercritical steam generators of The Babcock & Wilcox Company.

The economizer arrangement according to the present invention provides fuel flexibility through the use of water-cooled (stringer tube) supports, which allow for higher flue gas temperatures in comparison to conventional and existing mechanical supports; provides matched performance with fewer sections—thus increasing the side-spacing and minimizing concerns with slagging with a wide range of fuels; and also provides less erosion potential.

These features are provided in a design that matches the flow and efficiency performance of the existing components.

In addition, these features are provided in a design which fits within the existing economizer envelope of the steam generator.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENT

Figure 1:
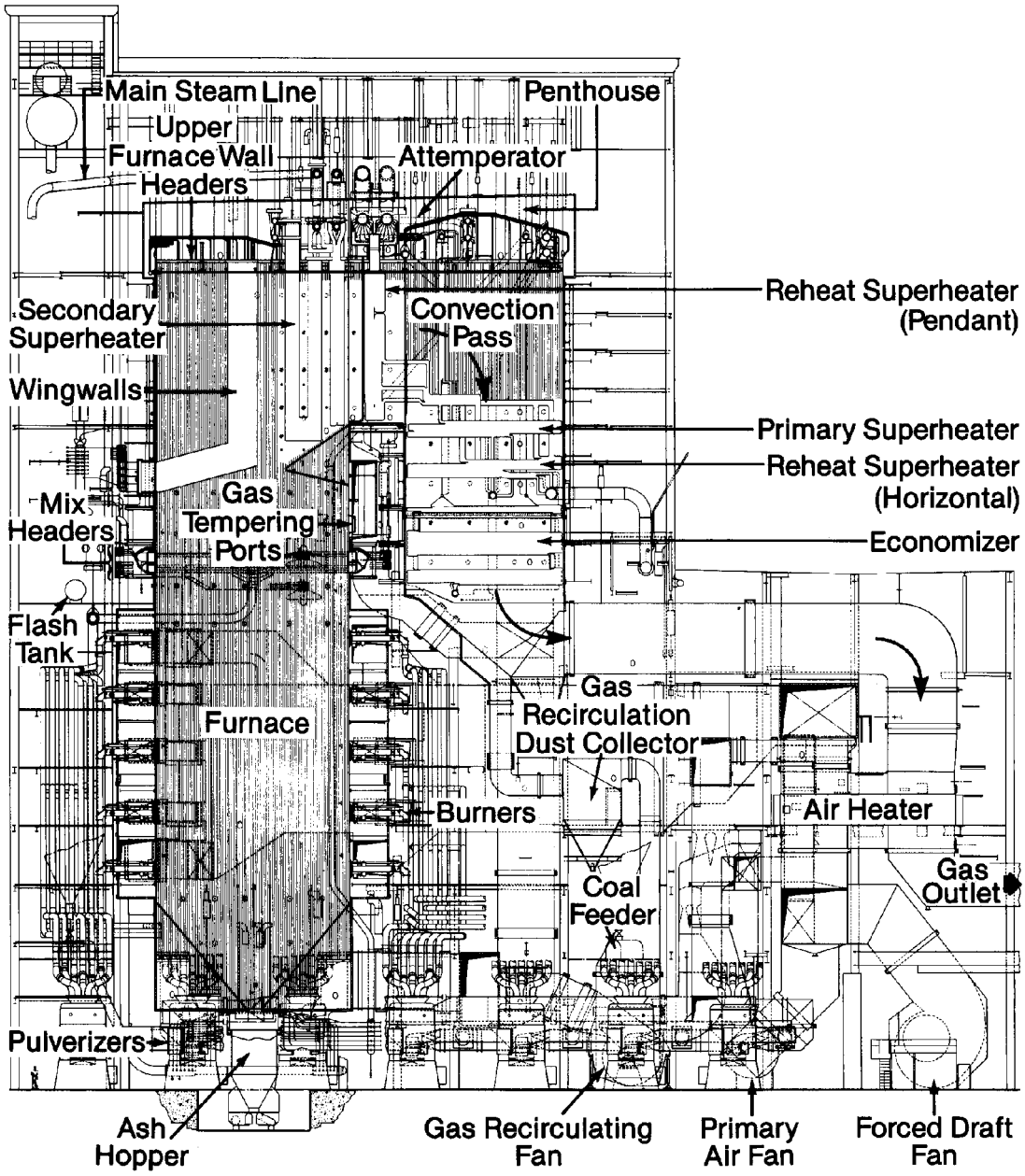
FIG. 1 (PRIOR ART)
FIG. 1 is a sectional side view of a prior art 1300MW B&W steam generator.
Figure 2:
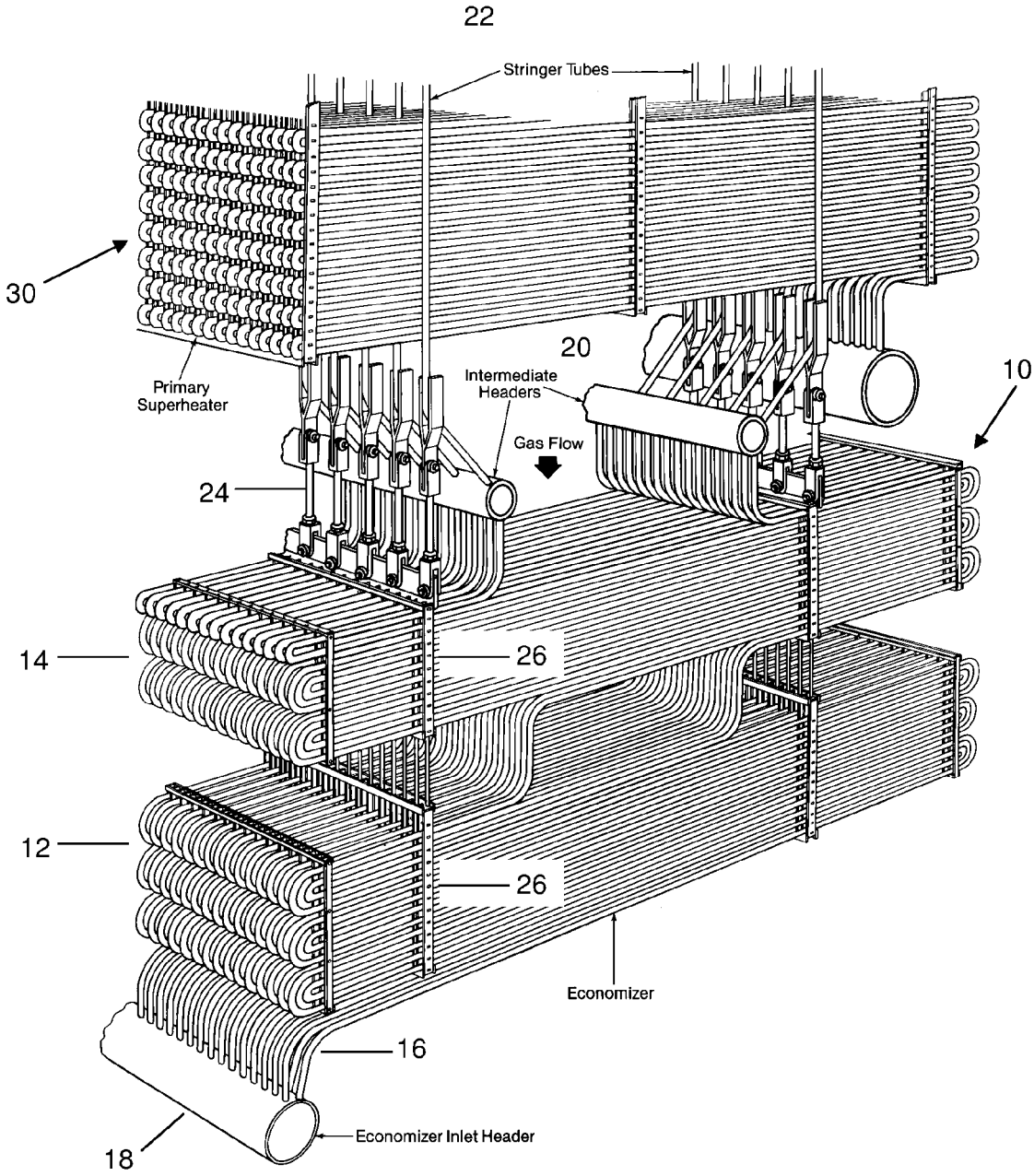
FIG. 2 (PRIOR ART)
FIG. 2 is a perspective illustration of a known economizer which employs mechanical supports.
Figure 3:
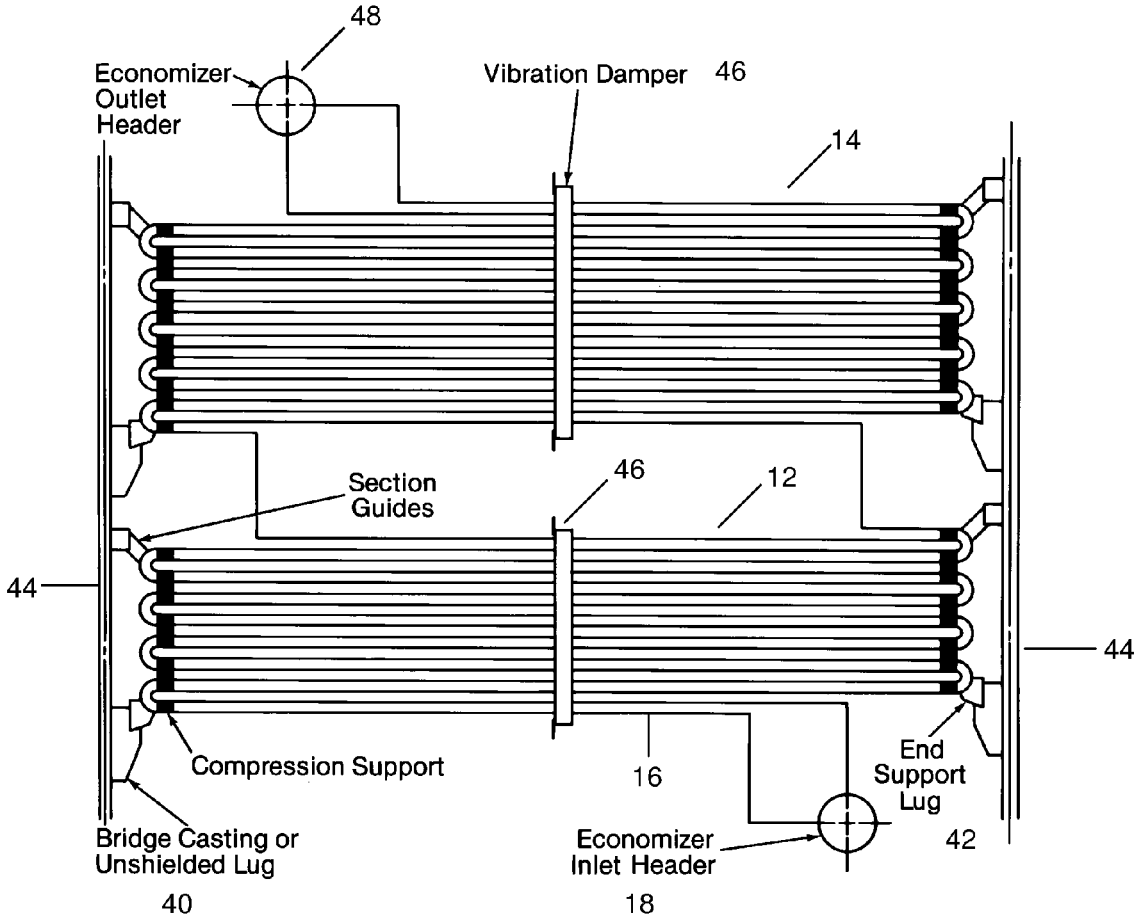
FIG. 3 (PRIOR ART)
FIG. 3 is a sectional illustration of a known end-supported economizer which employs mechanical supports from wall tubes.
Figure 4:
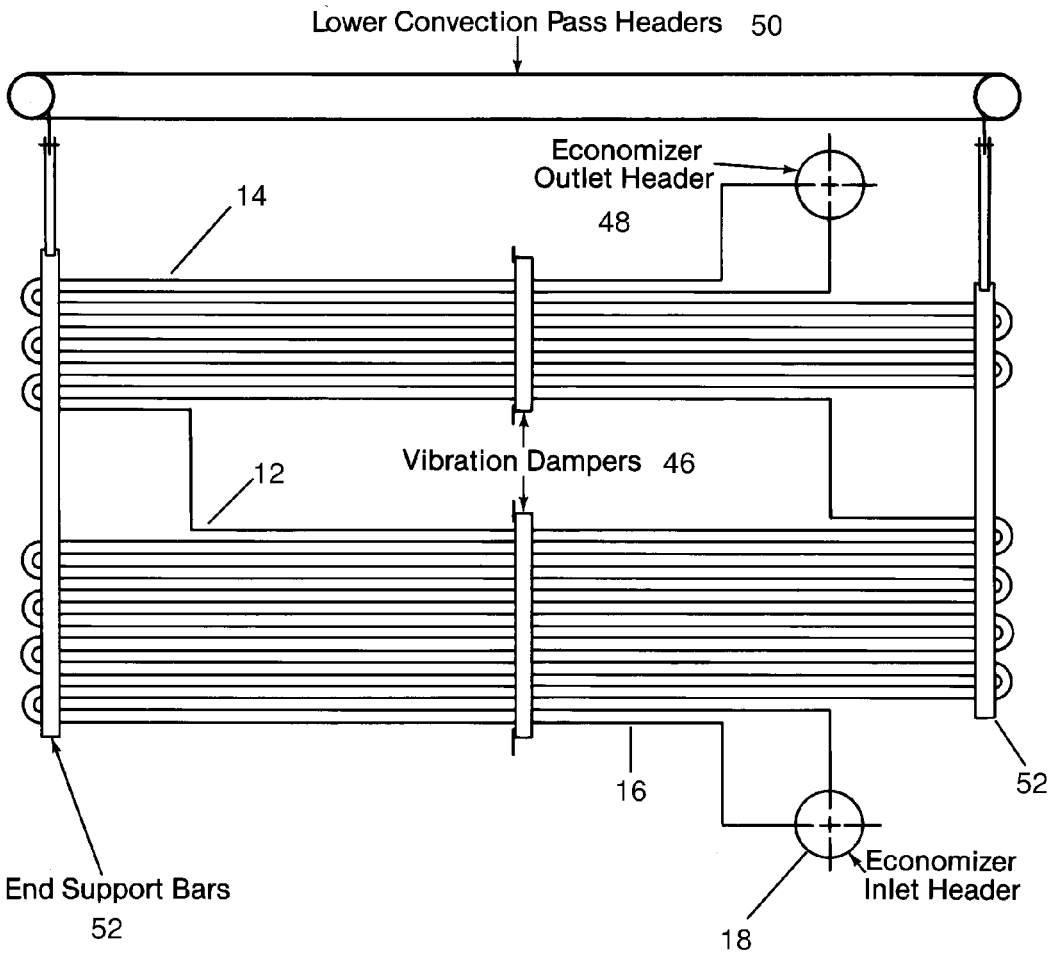
FIG. 4 (PRIOR ART)
FIG. 4 is a sectional illustration of another known end-supported economizer which employs end support bars connected to enclosure wall headers.
Figure 5:
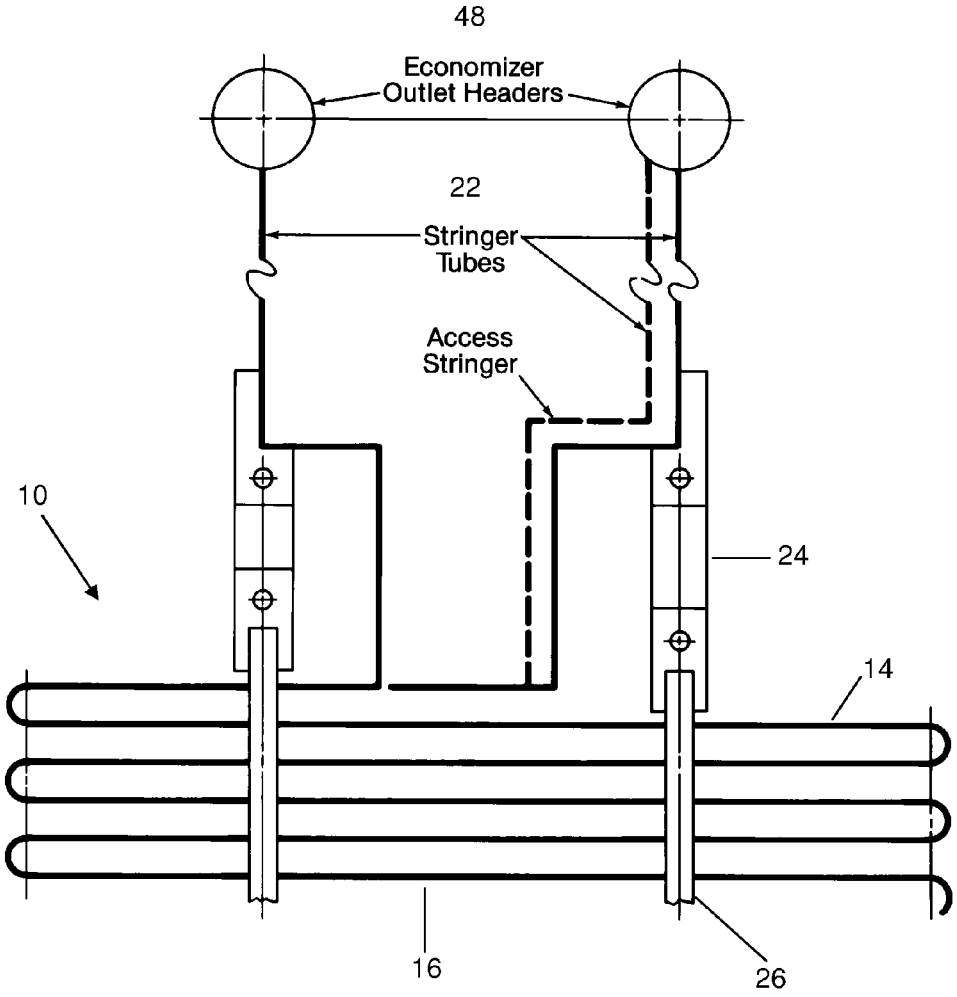
FIG. 5 (PRIOR ART)
FIG. 5 is partial sectional illustration of a known economizer which employs mechanical stringer supports.
Figure 6:
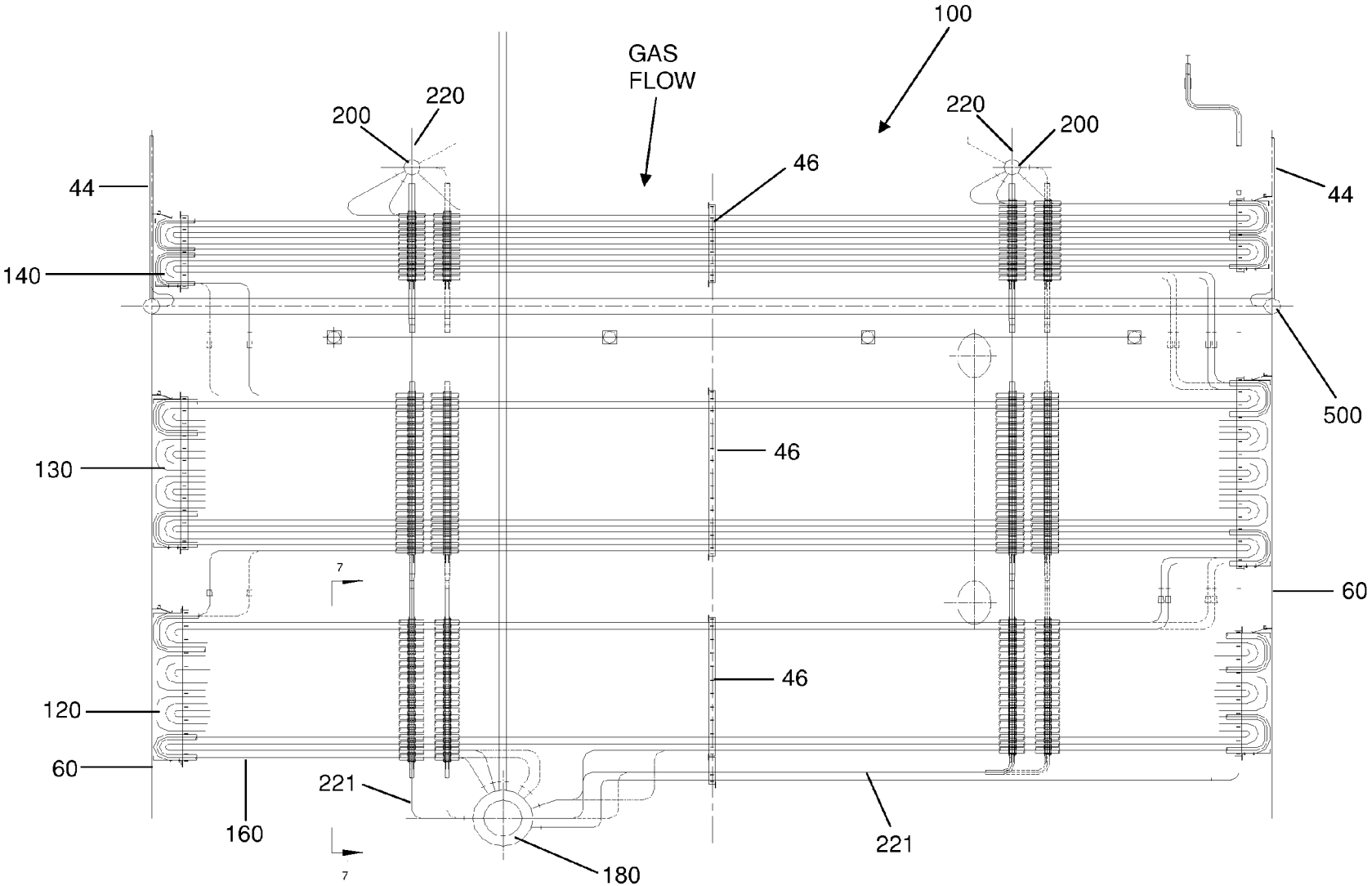
FIG. 6 is a sectional illustration of an economizer arrangement according to the present invention.

Referring to the drawings generally, wherein like reference numerals designate the same or functionally similar elements throughout the several drawings, and to FIG. 6 in particular, there is shown an economizer arrangement 100 having an inlet bank 120 an intermediate bank 130 and an outlet bank 140. Vibration dampers 46 may be provided as described earlier. An economizer inlet header 180 receives water and conveys it through both the tubes 160 and the water cooled stringer tubes 221. Two economizer intermediate headers 200 are provided at the water outlet of economizer 140. The water flows from the economizer intermediate headers 200 through the water cooled stringer tubes 221 to outlet headers, not shown.

The economizer 100 is comprised of three banks of tubes which absorb heat from the flue gas and transfer it to the water inside the tubes 160. The depth and width of these banks vary depending on the dimensions of the enclosed surface and the amount of heat absorption needed to meet outlet flue gas temperature demands. In the arrangement shown in FIG. 6, the fluid cooled enclosure surface 44 surrounds only the outlet bank 140 of economizer 100. The fluid cooled enclosure surface terminates at an enclosure header 500. Below that location, casing 60 defines the convection pass enclosure. On a typical economizer, mechanical supports would extend from the lowest bank 120 of the economizer 100 up through all the banks 130, 140 of the economizer 100. These uncooled mechanical supports would then connect to the stringer tubes carrying the water from the economizer intermediate headers 200 up through the rest of the horizontal convection pass, not shown.

In many existing steam generators, economics and emissions regulations have caused owners to switch fuels from the original design fuels. This fuel switch often results in higher gas temperatures entering the economizer. These higher temperatures can cause the traditional non-cooled mechanical support systems to become bulky and cost prohibitive.

Mechanical supports are generally used for their simplicity and suitability for a specific steam generator design aligned to a specific coal over a wide range of steam flows. However, changing the fuel source means that the steam generator performance will be affected and the resulting flue gas temperature profile across the heating surfaces will be different. For example, a unit designed for an eastern bituminous coal could see flue gas temperature increases of several hundred degrees when firing an alternative fuel such as a Powder River Basin coal. These increased flue gas temperatures can lead to de-rating of the steam generator output. In addition, the materials for such mechanical supports may become uneconomical because more expensive, higher alloys are needed.

The present invention addresses the need for a new support system which can accommodate higher flue gas temperatures which can occur at the economizer outlet bank 140 due to a change in fuel supply, such as from eastern bituminous coal to a sub-bituminous coal (e.g., Powder River Basin coal).

The present invention provides a customer with the ability to fire multiple fuels, without increasing the dimensions of the convection pass. It eliminates large, costly mechanical supports which are typically used on economizers, by using water cooled stringer supports.

Referring again to FIG. 6, the economizer 100 is a traditional three-flow design with the addition of a parallel circuit. The parallel circuit is comprised of water cooled stringer tube supports 221 which are fluidically connected to the economizer inlet header 180 and extend upwardly through the economizer inlet, intermediate, and outlet banks 120, 130, 140. The application of water cooled stringer tubes 221 in the present invention, where they are connected to the economizer inlet header 180 in a parallel circuit, is different than a traditional stringer supported economizer arrangements where the headers are connected to the intermediate economizer headers 200. It also differs from a typical three-flow economizer because the outlet flow of the water must be divided amongst multiple parallel paths which are created by the water cooled stringer system.

In this design, the water enters the economizer inlet header 180. The majority of the water then flows through the tubes 160 which form the banks of the economizer 100. A portion of water flowing into the economizer inlet header 180 is separately conveyed in the parallel path which comprises the water cooled stringer tube circuit 221. It is important to maintain a certain minimum flow through the water cooled stringer tube circuit 221 in order to keep the metal temperature forming this circuit within design limits. The maximum flow through the water cooled stringer tube support system 221 must also be limited in order to maintain the economizer performance within design limits. This is accomplished by determining the water flow through both the main tube banks forming the economizer 100 and through the water cooled stringer tube support system 221 which will meet both performance demands and integrity support over desired load range. Once the flow rates have been determined, a required specific pressure drop along each flow path is established. This could be accomplished by differential orificing at the economizer inlet header 180 to give the needed flow rates through the water cooled stringer tube support system 221. Alternatively, different internal diameter support tubes or tubes that are ribbed, hot finished or otherwise provided with a different pressure drop versus flow characteristics can be employed such as weld ring inserted into the flow path.

Figure 7:
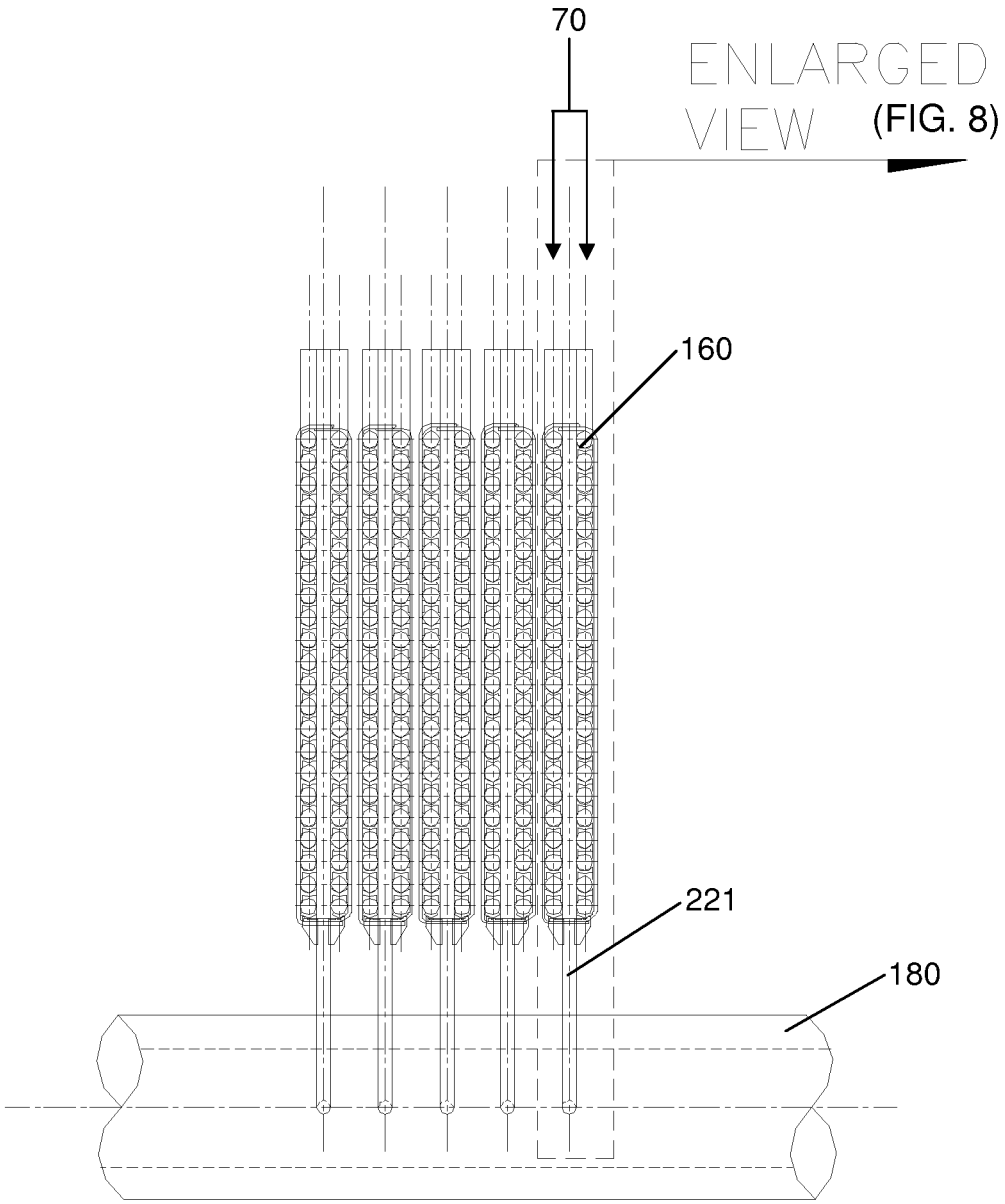
FIG. 7 is a an end view of a portion of the economizer arrangement of FIG. 6, viewed in the direction of arrows 7-7.
Figure 8:
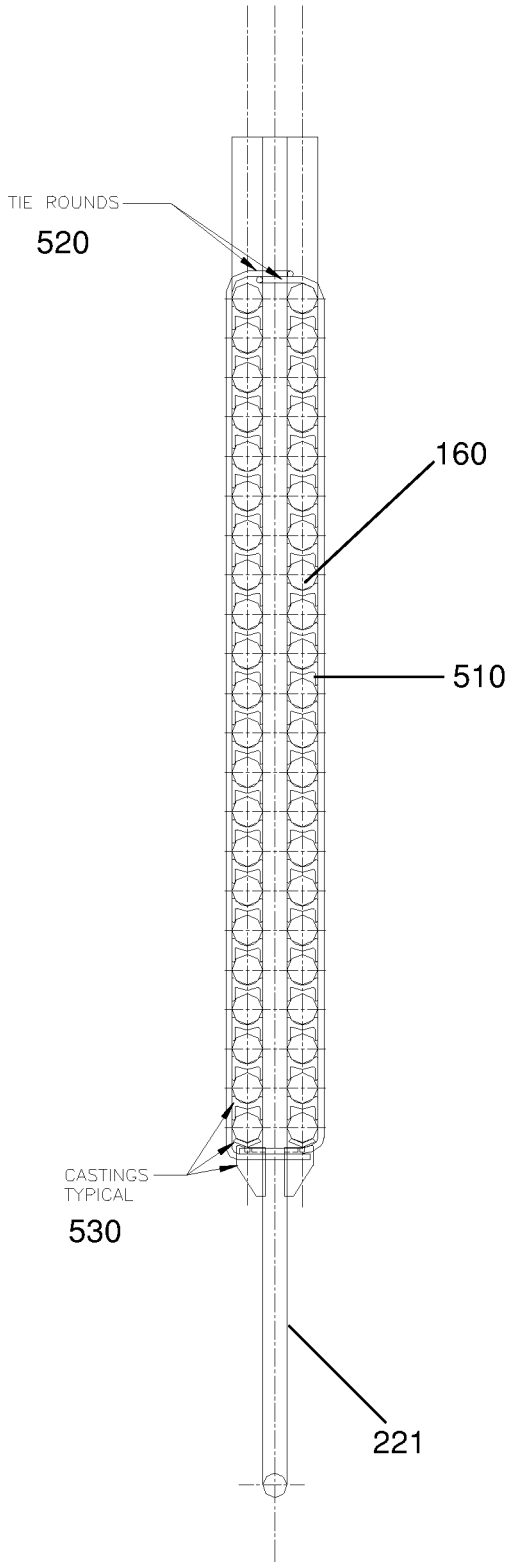
FIG. 8 is an enlarged view of a portion of the economizer arrangement of FIG. 7.

These water cooled stringer tube support system 221 extend from the economizer inlet header 180 up through the economizer inlet, intermediate, and outlet banks 120, 130, 140 through the clear space existing between the tubes of the economizer. As is known in the art, the economizer banks are comprised of continuous sections 70 (see FIG. 7) of tubes arranged side-by-side at a predetermined side spacing through which the flue gas passes. In the present invention, these water cooled tube supports 221 are provided with supports 510 (see FIG. 8) between each row of tubes 160. Preferably, tie rounds 520 surround two adjacent sections 70, and these tied sections rest upon castings 530 welded to the water cooled stringer tubes 221. As illustrated in FIGS. 7 and 8, a water cooled stringer support tube 221 is provided for a pair of adjacent sections 70. By welding the casting 530 to the water cooled stringer tubes 221, the castings are also water cooled, which allows for the use of lower grade materials.

The present invention achieves several benefits, the largest of which is the ability to provide an economical economizer arrangement which can be retrofitted to an existing steam generator. These supports eliminate the need for expensive, high alloy based mechanical support systems. This economizer design has the ability to give the same economizer performance as the existing economizer with multiple coals without having to move any pieces of equipment inside the convection pass (i.e. the inlet or intermediate headers). It also helps with maintenance concerns by increasing the reliability of the economizer and decreasing ash build-up due the increased spacing of the economizer.

While specific embodiments of the invention have been shown and described in detail to illustrate the application of the principles of the invention, it will be understood that the invention may be embodied otherwise without departing from such principles. For example, the present invention may be applied to new boiler or steam generator construction, or to the replacement, repair or modification of existing boilers or steam generators. In some embodiments of the invention, certain features of the invention may sometimes be used to advantage without a corresponding use of the other features. Accordingly, all such changes and embodiments properly fall within the scope of the following claims.

We claim:

1. A method of modifying a pre-existing steam generator designed to burn a limited range of coals, a furnace for burning the coal and producing a flue gas, a convection pass for receiving the flue gas, heat transfer surfaces located downstream gas flow-wise of the furnace, the heat transfer surfaces including a mechanically-supported economizer located in the convection pass, the method comprising the steps of:

retrofitting the pre-existing steam generator to burn a wider range of coals, the retrofitting including replacing the existing mechanically-supported economizer with a water cooled stringer tube-supported economizer.

2. The method of claim 1, further comprising the step of providing plural parallel water flow paths through the economizer and the supporting stringer tubes.

3. The method of claim 2, further comprising the step of providing a required pressure drop along selected parallel flow paths to achieve a desired flow rate through the selected paths.

4. The method of claim 3, wherein the step of providing a required pressure drop includes providing one of different internal diameter tubes, ribbed tubes, hot finished tubes, or an orifice weld ring inserted into the flow paths.

5. A pre-existing steam generator designed to burn a limited range of coals, a furnace for burning the coal and producing a flue gas, a convection pass for receiving the flue gas, heat transfer surfaces located downstream gas flow-wise of the furnace, the heat transfer surfaces including a mechanically-supported economizer located in the convection pass, and wherein the pre-existing steam generator is retrofitted to burn a wider range of coals, the retrofitting including the replacement of the existing mechanically-supported economizer with a water cooled stringer tube-supported economizer.

6. The pre-existing steam generator of claim 5, wherein the replacement economizer includes at least one bank of economizer tube sections having at least one flow path, water cooled stringer support tubes having at least one flow path, header means for providing water to the economizer tube sections and the water cooled stringer support tubes, and header means for receiving water from the economizer tube sections and the water cooled stringer support tubes.

7. The pre-existing steam generator of claim 6, wherein each of at least some of the water cooled stringer support tubes is straddled by a pair of economizer tube sections.

8. The pre-existing steam generator of claim 7, wherein the pair of economizer tube sections is straddled by a pair of tie bars with an overlapping end portion.

9. The pre-existing steam generator of claim 7, including a casting attached to the water cooled stringer support tube and at least a corresponding one of the pair of straddling economizer tube sections being supported by the casting.

10. The pre-existing steam generator of claim 9, wherein the casting is welded to the water cooled stringer support tube in order to be in thermal contact with the support tube so that under conditions of use the casting is cooled as a result of being in contact with the water cooled stringer support tube.

11. The pre-existing steam generator of claim 6, including support members in the form of concavo-concave blocks having recessed sides facing adjacent portions of the economizer tube sections.

12. The pre-existing steam generator of claim 11, wherein the recessed sides are shaped to conform to the cross-sectional shape of the confronted portions of the economizer tube sections.

13. The pre-existing steam generator of claim 6, including means for adjusting the pressure drop in at least one of the flow paths of the economizer tube sections and the water cooled stringer support tubes in order to achieve a desired flow therethrough.

14. The pre-existing steam generator of claim 13, wherein the pressure drop adjusting means includes at least one of different internal diameter tubes, ribbed tubes, hot finished tubes, or an orifice weld ring inserted into the flow paths.

* * * * *